United States Patent [19]

Davis, III

[11] Patent Number: 4,970,750

[45] Date of Patent: Nov. 20, 1990

[54] CLEANING DEVICE

[76] Inventor: Charles F. Davis, III, 2325 Seashell Rd., No. 305, Virginia Beach, Va. 23451

[21] Appl. No.: 407,957

[22] Filed: Sep. 15, 1989

[51] Int. Cl.[5] ..... A47L 13/16

[52] U.S. Cl. ..... 15/244.1; 15/228; 300/21

[58] Field of Search ..... 15/244.1–244.4, 15/119 A, 228, 245, 114, 115, 118; 300/21

[56] References Cited

U.S. PATENT DOCUMENTS

| | | | |
|---|---|---|---|
| 1,509,381 | 9/1924 | Townsend . | |
| 1,586,337 | 5/1926 | Stockwell . | |
| 2,070,123 | 2/1937 | Grant | 15/244.1 |
| 2,138,712 | 11/1938 | Saffert | 15/244.1 |
| 2,790,193 | 4/1957 | Wilding | 15/210 |
| 3,090,985 | 5/1963 | Baum | 15/244 |
| 3,214,779 | 11/1965 | Wheeler | 15/244 |
| 3,225,375 | 12/1965 | Atkinson et al. | 15/210 |
| 3,262,145 | 7/1966 | Carlson | 15/244.1 |
| 3,274,635 | 9/1966 | Myers | 15/244 |
| 3,353,203 | 11/1967 | Ginter | 15/244 |
| 3,491,397 | 1/1970 | Hesener | 15/118 |
| 3,785,000 | 1/1974 | Zacha et al. | 15/244.1 |
| 4,317,250 | 3/1982 | Shutts | 15/244.1 |

*Primary Examiner*—Edward L. Roberts

*Attorney, Agent, or Firm*—Griffin, Branigan & Butler

[57] ABSTRACT

A cleaning device (10) for bathtubs, shower enclosures, and the like comprises a sponge block having an outer surface which substantially defines a rectangular polyhedron in shape and which has a cavity (34) cut into a top surface thereof which is similarly shaped and oriented correspondingly as is the outer surface of the sponge block. A rigid support block (14), having an outer surface with length and breadth dimensions which are approximately the same as the size and shape of the length and breadth dimensions of a cavity surface, is adhered in the cavity by a chemical (cleaning), detergent, and water resistant, elastic, adhesive (18) and an elongated handle (16) is attached to a top surface of the support block. The sponge block is constructed of reticulated sponge material and distances between side, end, and bottom surfaces of the support block and the sponge outer surface fall in a range from ½ inch to 2.5 inches. Bottom edges of the support block and the sponge block cavity are beveled surfaces (56, 45). A bottom surface (54) of the support block has minimum length and breadth dimensions of 1½ inches. Side and end surfaces (46–52) of the support block have minimum length dimensions of 1½ inches and minimum height dimensions of ½ of an inch.

13 Claims, 3 Drawing Sheets

CLEANING DEVICE

BACKGROUND OF THE INVENTION

This invention relates broadly to the art of cleaning devices, and methods of constructing cleaning devices, which comprise sponges or sponge-like material on the ends of elongated handles.

Over the years there have been a number of cleaning devices suggested comprising elongated handles having sponges, or sponge-like material, on the ends thereof. For example, U.S. Pat. No. 3,491,397 to Hesener describes a cleaning device in which a support core is inserted into a hole in a sponge-like block and is attached thereto. The support core has an elongated handle attached thereto for manipulating the block. Although the Hesener cleaning device has some advantages, a major difficulty with it is that various support surfaces described therein do not provide adequate backup support for bottom, side, and end outer surfaces of the sponge-like block for applying required cleaning pressures without damaging the sponge-like block. Thus, it is an object of this invention to provide a cleaning device wherein a sponge-like block is attached to a support block in which side, end, and bottom outer surfaces of the sponge-like block are adequately supported by the support block to apply needed cleaning pressures without unduly damaging the sponge-like block.

A particular difficulty with the cleaning device of Hesener is that some of the dimensions of the support core shown therein are unduly small which causes cutting of the sponge when the sponge is being applied for cleaning in certain directions. Thus, it is an object of this invention to provide a cleaning device wherein a sponge-like block is not cut or otherwise quickly and/or unduly damaged by a support block when the cleaning device is being used for cleaning.

Another sponge mop is disclosed in U.S. Pat. No. 3,274,635 to Myers. The sponge mop of Myers has outer surfaces which are spaced, at some points, great distances from an internal supporting member and at other locations only small distances from the internal supporting member. Such ununiform sponge thicknesses inhibit uniform cleaning and lead to ununiform strains and stresses placed on the sponge. These ununiform strains and stresses create quick deterioration of the sponge, which of course is undesirable. Thus, it is an object of this invention to provide a cleaning device wherein a sponge block is adequately supported by a support block so to have uniform strains and stresses over the sponge block so as to not create undue wear on the sponge block when it is being used for cleaning.

Yet another difficulty with many prior art devices is illustrated in U.S. Pat. Nos. 3,090,985 to Baum and 1,509,381 to Townsend. Sponges in the devices of these patents are wrapped on unusually shaped internal supports and are so thin that they can only be used for cleaning specifically shaped objects. They do not allow one to easily clean in corners and grooves. Thus, it is an object of this invention to provide a cleaning device having a sponge block and support block which can be used for cleaning objects of most shapes, and, in particular can be used for cleaning in sharp corners and in grooves.

SUMMARY OF THE INVENTION

According to principles of this invention, a cleaning device comprises a sponge block whose side, end, and bottom external surfaces substantially define an external rectangular polyhedron and having a sponge cavity therein whose side, end, and bottom internal surfaces substantially define an internal rectangular polyhedron whose orientation corresponds to the orientation of the external rectangular polyhedron. A rectangular support block of substantially the same size and shape as the cavity is adhered in the cavity by means of a water, detergent and chemical resistant elastic adhesive. Distances between the respective internal and external side, end, and bottom surfaces of the sponge block, that is, the thicknesses of sponge-block walls, are approximately equal and fall in a range from 0.5 inches to 2.5 inches. The support block has blunt edges between a bottom surface and side and end surfaces thereof and the cavity of the sponge block has a corresponding shape. A bottom surface of the support block has minimum length and breadth dimensions of 1½ inches. Side and end surfaces of the support block have a minimum length dimensions of 1½ inches and minimum height dimensions of ½ of an inch.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
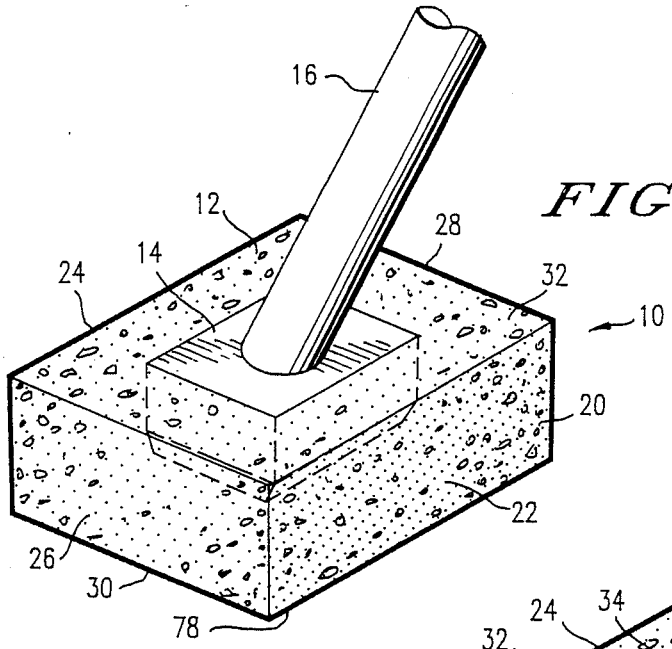
FIG. 1 is an isometric view of a cleaning device of this invention.
Figure 2:
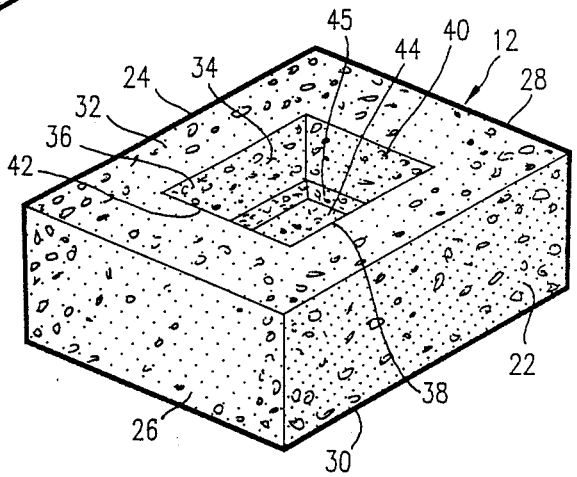
FIG. 2 is an isometric view of a sponge block of the cleaning device of FIG. 1.
Figure 3:
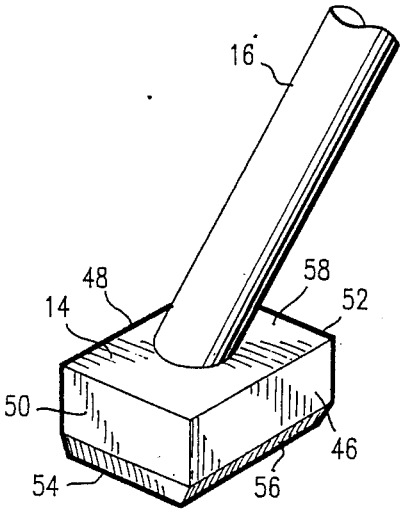
FIG. 3 is an isometric view of a support block and attached handle of the cleaning device of FIG. 1.

Referring now to the drawings, a cleaning device 10 comprises a sponge block 12, a support block 14, a handle 16 and an elastic adhesive 18 between the sponge block 12 and the support block 14.

The sponge block 12 has an outer surface 20 which has a rectangular polyhedron shape. That is, in cross-sectional planes in length, breadth, and height orthogonal directions, the outer surface 20 defines rectangular shapes. Rectangles defined in parallel planes of each orthogonal direction are uniform in size and shape. In other words it is a rectangular polyhedron with side surfaces 22 and 24 being rectangular in shape and equal in size, end surfaces 26 and 28 being rectangular in shape and equal in size and a bottom external surface 30 being rectangular in shape. Each of the side external surfaces 22 and 24, end external surfaces 26 and 28 and bottom external surface 30 is substantially flat and, in a preferred embodiment, a top external surface 32 is also flat, however it is not as necessary for this surface to be flat as for the other surfaces to be flat.

A cavity 34 is cut into the top external surface 32 of the sponge block 12. The cavity 34 has side internal surfaces 36 and 38, end internal surfaces 40 and 42, and a bottom internal surface 44, all of which define a rectangular polyhedron in which cross-sectional planes in length, breadth and height orthogonal directions define rectangular shapes, rectangles defined in parallel planes of each orthogonal direction being uniform in size and shape. The internal rectangular polyhedron of the cavity is oriented in the same manner as the external rectangular polyhedron of the outer surface 20. Notwithstanding the general rectangular polyhedron shape of the cavity 34, transitions between the bottom internal surface 44 and the side and end internal surfaces 6–42 are formed by small beveled surfaces 45 which cause the edges between the bottom internal surface 44 and the side and end internal surfaces 36–42 to be quite blunt. In a preferred embodiment, the cavity 34 is three inches long (that is, the distance between the end internal surfaces 40 and 42), 2 inches in breadth (the distance between the side internal surfaces 36 and 38) and 1¼ inches in depth (the distance between the top external surface 32 and the bottom internal surface 44). However, one should be aware that the length and breadth dimensions of the cavity 34 could be as great as five inches and as small as 1½ inches within this invention. Similarly, the depth of the cavity 34 could be as small as ½ inch or as large as 2½ inches.

In a preferred embodiment, the rectangular dimensions of the cavity 34 are related to the rectangular dimensions of the outer surface 20 in that the thicknesses of the walls of the sponge block 12, (that is, the distances between the side external surface 22 and the side internal surface 38, the side external surface 24 and the side internal surface 36, the end external surface 28 and the end internal surface 40, the end external surface 26 and the end internal surface 42, and the bottom external surface 30 and the bottom internal surface 44), are approximately equal. In a preferred embodiment, the thickness of each of these walls is 1 inch, but they can vary. In this regard, however, the thickness of these walls cannot be less than ½ inch and cannot be greater than 2 inches. If the thickness of these walls is less than ½ inch, there is not enough flexibility in the sponge block to go into corners and grooves to be cleaned out. If, on the other hand, the walls are greater than 2 inches in thickness, there is not sufficient support for applying pressure from the support block 14 to the various side, end, and bottom surfaces of the outer surface. Also, when the sponge block is used, portions of it being pushed along a surface to be cleaned will tend to rotate on the support block 14, which will tend to rip it away from the support block 14 and to cause unacceptable wear of the sponge block 12.

Figure 6:
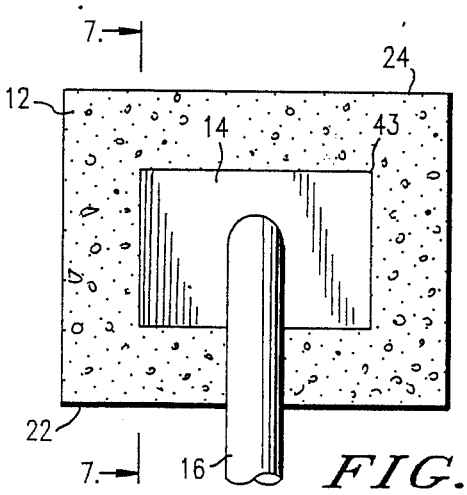
FIG. 6 is a top view of the cleaning device of FIG. 1.

The support block 14 has side surfaces 46 and 48, end surfaces 50 and 52, and a bottom surface 54 which correspond in shape and size to the shape and size of the cavity 34 so that the support block 14 fits snuggly into the cavity 34. The support block 14 also includes beveled surfaces 56 at the intersections of its side and end surfaces 46–52 with the bottom surface 54 to correspond to the beveled surfaces 45 of the cavity 34. Also, with reference to FIG. 6, all of the corners 43 of the support block 14 are sanded down so as to be rounded and smooth. Thus, they do not cut into the sponge block 12 when it is used for cleaning. The handle 16 is rigidly attached to a top surface 58 of the support block 14.

In a preferred embodiment, the sponge block 12 is constructed of a reticulated double cell flexible foam material, which means that the spaces, or holes therein, are not closed. This sponge material has very low water and detergent absorption characteristics and therefore does not hold much water or detergent. Another particular product which can be used for the sponge-like material is SCOTT industrial foam (SIF) made and sold by Scotfoam Corporation, 1500 East Second Street, Eddystone, Pa. 19013, which is constructed of polyurethane. Further, it has been found that the sponge block 12 functions best when its pores per linear inch fall in the range of from 50–80, preferably around 50. This is a type of foam that is normally used for filters.

The cleaning device 10 of this invention is constructed by blanking a sponge block to a proper shape from a large sheet of sponge material, that is, cutting its side and end external surfaces as well as its top and bottom external surfaces. Thereafter the cavity 34 is cut therein. An elastic contact-type adhesive 18 is uniformly placed on the side, end and bottom surfaces of the support block 14, and before this contact-type adhesive can fully "tack up" the sponge block cavity 34 is mechanically stretched open to be wider than the support block 14 and the support block 14 is inserted thereinto so that the bottom surface 54 is adhered to the bottom internal surface 44. This stretching of the cavity permits the support block 14 to be inserted without disturbing the adhesive and allowing adhesive coverage to remain uniform. When the cavity is allowed to be returned to its normal size its side and end surfaces 36–42 adhere to the side and end surfaces (46–52) of the support block 14. The purpose of applying the adhesive 18 only on the support block 14 is that the support block 14 serves as a good base for the adhesive whereas the sponge material does not. As adhesion occurs first on the block it is firmly drawn to the block thereby preventing excess adhesive from being absorbed by the sponge block as it adheres thereto. Further, such elastic adhesives are resilient and thereby form a resilient cushion between the sponge block 12 and the support block 14.

It has been determined that the bottom surface 54 of the support block 14 must have minimum length and breadth dimensions of 1½ inches. Side and end surfaces 46–52 of the support block 14 must have length dimensions of at least 1½ inches and if these minimum dimensions are not met, outer surfaces of the sponge block 12 are not adequately supported for proper cleaning and the sponge block 12 itself tends to deteriorate too fast.

Figure 4:
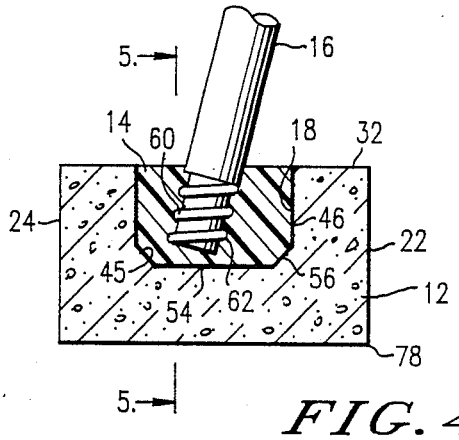
FIG. 4 is a partially, cross-sectional view taken on lines 4—4 in FIG. 5 of the cleaning device of FIG. 1.
Figure 5:
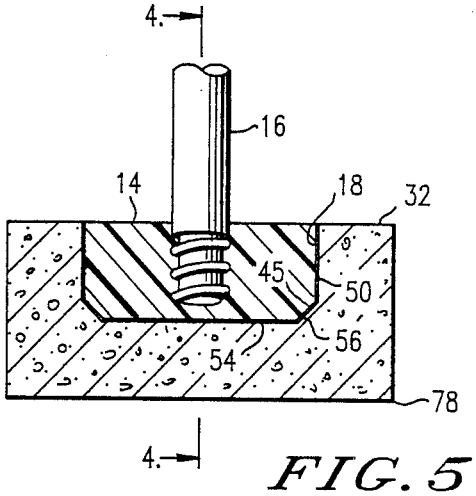
FIG. 5 is a partially, cross-sectional view taken on lines 5—5 in FIG. 4 of the cleaning device of FIG. 1.

In the preferred embodiment, as can be seen in FIG. 4 the handle 16 has male threads 60 on an outer end thereof which screw into female threads 62 in the top surface of the support block 14.

Figure 7:
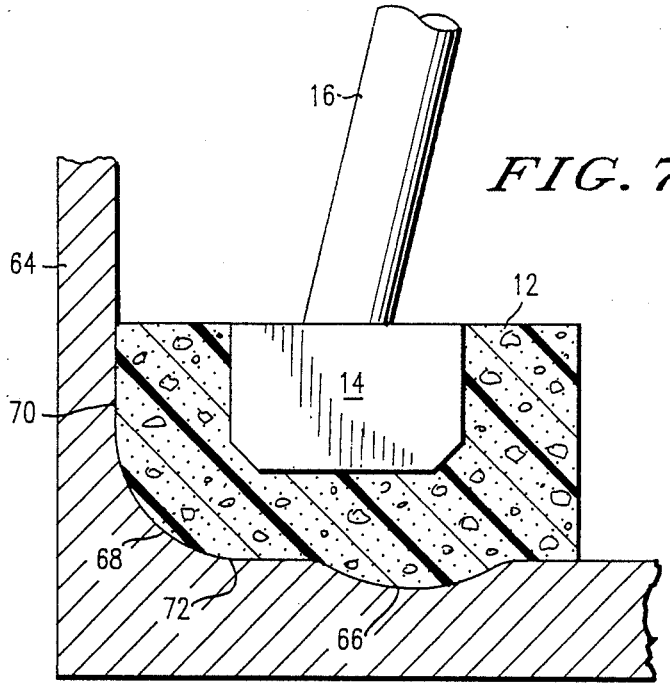
FIG. 7 is a cross-sectional view taken on lines 7—7 in FIG. 6 and further including a cross-section of a bathtub.

The cleaning device 10 is shown being used for cleaning a tub 64 in FIG. 7. In this regard, the sponge block 12 is shown being pushed down into a drain depression 66 and into a corner contour 68 at the same time it cleans a side 70 and a bottom 72 of the tub 64.

Figure 8:
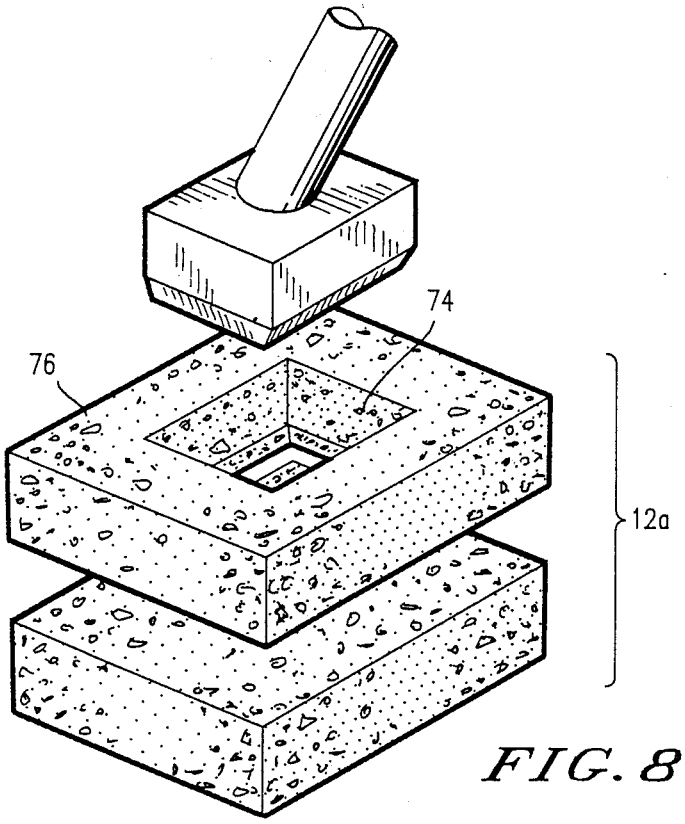
FIG. 8 is an exploded isometric view of an alternate embodiment of the cleaning device of the other drawings.

An alternate embodiment of this invention is shown in FIG. 8 which is quite similar to the embodiment of the other figures with the exception that a sponge block 12a is constructed of two pieces of absorbent material, or sponges. The reasons for this is to allow a cavity 74 to be blanked out of a first sponge piece 76 with dies.

It should be understood that the word "sponge" as used herein includes both man-made and natural sponges as well as other similar absorbent materials.

A particular benefit of this invention is that it provides a cleaning device in which a sponge block is securely supported by and adhered to an inlaid rigid, sponge support block with a detachable handle. The support block is of a size and shape relative to the sponge block such that when pressure is applied to the sponge block via the support block and handle, one or more of its surfaces is pressed with uniform pressure across the surface to be cleaned. The sponge block will automatically adapt itself to effectively clean surfaces riding into recesses and contours without unduly damaging or wearing the sponge block.

The reticulated sponge block, constructed of a man-made sponge-like material, has low liquid water and detergent retention characteristics which permit it to be easily rinsed by positioning the sponge block under a faucet with the handle and then compressing surfaces of the sponge block between surfaces of a bathtub or shower enclosure and the support block. Any remaining liquid can easily be removed by compressing the sponge block by hand against the surface of the sponge support block.

Also, this low retention of liquids etc. prolongs sponge life in that as it is manipulated during cleaning processes the sponge will not carry a large load of water whoes weight would tend to pull the sponge away from the block.

It should be understood that the support block 14 is a solid, rigid, material, such as either a wood or hard plastic. It could be a molded plastic with hollow cavities or it could be semi-rigid. It must be rigid enough to support a handle.

It should be understood that by using a rigid support block, inlaid into the sponge block, and adhering these two members together by an elastic adhesive which remains flexible after it has cured, surfaces to be cleaned with the cleaning device of this invention are protected. For example, typical bathtub and shower enclosure finishes can be harmed or marred when they are contacted by hard frames during cleaning, however, the flexible contact adhesive provides a cushion between the rigid support block and the bathtub finish.

A particular important aspect of this invention is that every outer surface of the sponge block is a cleaning surface and is firmly supported as such by the support block. Even the corners of the outer surface of the sponge block are supported. Further, all corners of the support block are sanded down so as not to be sharp and not to cut into the sponge block and reduce the life thereof.

Thus, all intersections of the side, end and bottom surfaces of the support block are devoid of sharp points. As the beveled surfaces provide major protection from cutting the sponge material, these rounded corners provide minor protection.

It will be further understood by those of ordinary skill in the art that by blunting lower edges of the support block 14 and the cavity 34 with beveled surfaces, the sponge block 12 is protected at its lower corners from puncture and excessive wear. Further, an increased thickness between lower external surface edges 78 of the sponge block 12 and the beveled surfaces 56 of the support block 14, caused by a geometry of these respective members, further provides cushioning between these elements. The lower external surface edges 78 are used to clean in grooves and in corners.

The embodiments of the invention in which an exclusive property or privilege are defined as follows.

I claim:

1. A cleaning device for bathtubs, shower enclosures, and the like comprises:

a sponge block having an outer surface with side and end external surfaces and a bottom external surface defining approximately an external rectangular polyhedron, that is, a polyhedron whose cross-sectional planes define rectangular shapes in length, breadth and height orthogonal directions, the rectangular shapes in parallel planes of each orthogonal direction being uniform in size and shape, said sponge block being constructed of a sponge like material having a cavity cut into a top surface thereof and extending a substantial distance down into said rectangular sponge block, said rectangular cavity having a cavity surface with side, end, and bottom internal surfaces defining approximately a cavity rectangular polyhedron oriented in a manner corresponding to said external rectangular polyhedron;

a rigid support block having an outer surface with length and breadth dimensions which are approximately the same size and shape of the length and breadth dimensions of said cavity surface and with a height dimension which is at least approximately as great as a height dimension of said cavity surface;

a water, detergent and chemical-cleaner resistant elastic adhesive for adhering side, end and bottom surfaces of said rigid support block to said side, end and bottom surfaces of said cavity surface; and an elongated handle attached at said top surface of said support block;

whereby said handle can be used to manipulate said sponge block for cleaning bathtubs, shower enclosures, and the like while in a standing position.

2. A cleaning device as in claim 1 wherein walls of said sponge block, that is, the distances between internal side, end, and bottom surfaces and respective external side, end and bottom surfaces of said sponge block are approximately equal.

3. A cleaning device as in claim 2 wherein the sponge block wall thicknesses are in a range of from ½ inch to 2 inches.

4. A cleaning device as in claim 1 wherein the sponge block wall thicknesses are in a range of from ½ inch to 2 inches.

5. A cleaning device as in claim 1 wherein the sponge block is constructed of a reticulated sponge-like material.

6. A cleaning device as in claim 5 wherein the sponge block wall thicknesses are in a range of from ½ inch to 2 inches.

7. A cleaning device as in claim 1 wherein said support block has blunt edges formed at intersections of side and end external surfaces with a bottom surface thereof and wherein the cavity is defined by a blunt edge at a corresponding intersection thereof.

8. A method of constructing a cleaning device comprising the steps of:

preparing a sponge block having side, end, and bottom outer surfaces substantially defining a rectangular polyhedron shape, said sponge block being constructed of a sponge-like material;

cutting a cavity in a top surface of the sponge block, said cavity having side, end, and bottom surfaces which substantially define a rectangular polyhedron;

preparing a rigid support block constructed of a rigid material, said support block having side, end, and bottom surfaces substantially defining a rectangular polyhedron of a shape and size corresponding to the shape and size of said cavity in said sponge block;

adhering side, end and bottom external surfaces of the support block to side, end and bottom internal surfaces of said cavity with a resilient adhesive;

rigidly attaching an elongated handle to a top surface of said support block;

wherein the thickness of walls of said sponge block, that is, the distances between side, end, and bottom internal surfaces of said cavity and respective side, end, and bottom external surfaces of said sponge block, are at least ½ inch but not more than 2 inches.

9. A method of constructing a cleaning device as in claim 8, wherein the thickness of said sponge block walls is made to equal for all walls.

10. A method of constucting a cleaning device as in claim 9 wherein the thickness of said walls is made to be around 1 inch.

11. A method of constructing a cleaning device as in claim 8 wherein said sponge block is constructed of a reticulated sponge-like material.

12. A method of constructing a cleaning device as in claim 8 wherein the intersections of said external side and end surfaces with external said external bottom surface of said support block are beveled.

13. A method of constructing a cleaning device as in claim 8 wherein the adhering step includes the substeps of placing an adhesive uniformly on the side, end, and bottom surfaces of the support block, allowing said adhesive to cure, stretching the sponge block so as to expand said cavity, inserting said support block into said cavity without disturbing the adhesive on the side and end surfaces of the support block until said bottom surface of said support block contacts the bottom surface of said cavity, and allowing said cavity to return to its normal size, thereby allowing said side and end surfaces of said support block and said cavity to respectively adhere to one another.

* * * * *